US006004170A

United States Patent [19]

Kato et al.

[11] Patent Number: 6,004,170

[45] **Date of Patent: *Dec. 21, 1999**

[54] CONNECTION STRUCTURE OF A COVERED WIRE WITH RESIN ENCAPSULATION

[75] Inventors: Tetsuo Kato; Nobuyuki Asakura; Akira Shinchi; Tetsuro Ide, all of Shizuoka-ken, Japan

[73] Assignee: Yazaki Corporation, Tokyo, Japan

[ * ] Notice: This patent is subject to a terminal disclaimer.

[21] Appl. No.: 08/956,941

[22] Filed: Oct. 23, 1997

[30] Foreign Application Priority Data

Oct. 25, 1996 [JP] Japan ..... 8-284256
May 22, 1997 [JP] Japan ..... 9-132469

[51] Int. Cl.[6] ..... H01R 4/02

[52] U.S. Cl. ..... 439/874; 174/84 R; 29/872

[58] Field of Search ..... 439/874; 174/84 R; 29/872

[56] References Cited

U.S. PATENT DOCUMENTS

| | | | |
|---|---|---|---|
| 3,842,487 | 10/1974 | Hartz | 439/874 |
| 4,878,969 | 11/1989 | Janisch | 174/84 R |
| 5,191,710 | 3/1993 | Fujimaki et al. | 439/874 |
| 5,584,122 | 12/1996 | Kato et al. | 29/872 |
| 5,857,259 | 1/1999 | Johnston | 29/872 |
| 5,869,784 | 2/1999 | Shinchi | 174/84 R |

FOREIGN PATENT DOCUMENTS

| | | |
|---|---|---|
| 35 37 167 | 10/1985 | European Pat. Off. . |
| 197 23 215 | 6/1997 | European Pat. Off. . |
| 197 23 216 | 12/1997 | European Pat. Off. . |
| 07-320842 | 12/1995 | Japan . |

*Primary Examiner*—Paula Bradley
*Assistant Examiner*—Katrina Davis
*Attorney, Agent, or Firm*—Finnegan, Henderson, Farabow, Garrett & Dunner, L.L.P.

[57] ABSTRACT

A covered wire connection structure is formed by the steps of: pinching a covered wire with a pair of resin chips; pressing and exciting a cover portion of the wire by ultrasonic vibration so as to conductively connect conductive portions of both the covered wires at the connection portion; and melting a pair of the resin chips so as to seal the connection portion. The resin chip comprises main melting portions for pinching the connection portion which are melted to a mating resin chip so as to seal the connection portion, and auxiliary melting portions which are formed of material compatible with the cover portion of the covered wire introduced from the main melting portions and pinch the cover portion such that they are melted to the mating resin chip. The auxiliary melting portions and cover portion of the covered wire are melted together and integrated so as to seal an introductive portion of the covered wire from the resin chips. As a result, a reliability in connecting the covered wires by ultrasonic vibration is maintained and waterproofness in the connection portion is improved.

11 Claims, 10 Drawing Sheets

CONNECTION STRUCTURE OF A COVERED WIRE WITH RESIN ENCAPSULATION

BACKGROUND OF THE INVENTION

This invention relates to a connection structure for conductively connecting covered wires (conductor) with each other or connecting a covered wire to another member.

As a conventional connection structure of this kind of covered wire, an art proposed by this applicant (see Japanese Unexamined Published Patent Application No.Hei7-320842) will be described.

When connecting two covered wires an outer periphery of which is coated with a cover portion made of resin, at their intermediate connection portions, a pair of resin chips which are of resin material, a horn for producing ultrasonic vibration, and an anvil for supporting the covered wires and the resin chips at the time of connection are utilized.

The anvil comprises a base stand and a support portion projecting from the base stand. The support portion is formed in a substantially cylindrical shape. The support portion has a bore portion which is open to a counter-side of the base stand. Two pairs of grooves are formed in the peripheral wall of the support portion so as to confront each other of the respective pairs across substantially a center of the bore portion. The four grooves are formed so as to open to the same side as the bore portion, extending along the projection direction of the support portion and intercommunicate with the confronting ones through the bore portion.

A pair of resin chips are formed in a disc shape having a slightly smaller outer diameter than the diameter of the bore portion of the anvil. Furthermore, an end portion of a head portion of the horn is formed in a disc shape having an outer diameter which is slightly smaller than that of the resin chips.

In order to connect the two covered wires to each other, both of the covered wires are overlapped with each other at connection portions thereof and the overlapped portions are pinched by a pair of resin chips from up and down. Specifically, one of the resin chips (the resin chip at the lower side) is inserted into the bore portion of the anvil such that the melting surface thereof is directed upward. Then, one covered wire is inserted into one pair of the confronting grooves from the upper side of the inserted resin chip. Then, the other covered wire is inserted into the other pair of the confronting grooves. Finally, the other (upper side) resin chip is inserted such that the melting surface is directed downward. The covered wires are arranged in the bore portion such that the respective connection portions thereof cross each other at the center of the bore portion. Through this arrangement, the connection portions of the covered wires are pinched substantially at the center of the melting surfaces of the upper and lower resin chips in the overlapping direction.

Subsequently, the cover portions at the connection portions of the covered wires are melted so as to be dispersed by ultrasonic vibration. Furthermore, the conductive wire portions (core) of the covered wires are made into conductive contact with each other at the connection portions by pressing the covered wires from the outside of the resin chips. Thereafter, the pair of the resin chips are mutually melted at the melting surfaces to seal the connection portions.

Consequently, the connection portions of the two covered wires are sealed by the pair of the resin chips such that they are conductively contacted with each other.

However, such a connection structure has a fear that the covered portions of the wires may be broken by an edge portion of the resin chip at an exit of the covered wire between the resin chips. If the covered portion is broken, there is a fear that water may penetrate through that broken portion.

SUMMARY OF THE INVENTION

Accordingly, it is an object of the present invention to provide a connection structure for covered wires, which enables improvement of waterproofness of a connection portion while maintaining a reliability in connecting covered wires with each other and a covered wire with another conductor by means of ultrasonic vibration.

According to the present invention, there is provided a covered wire connection structure for conductively connecting members at least one of which is a covered wire having a conductive wire portion and a cover portion formed by coating resin around an outer periphery of the conductive wire portion, the covered wire connection structure formed by the steps of: overlapping the members with each other at a connection portion; pinching the connection portion between resin materials; melting and removing the cover portion by an ultrasonic vibration; pressing the resin materials from an outside thereof so as to conductively connect the members at the connection portion and melting the resin materials by the ultrasonic vibration so as to be fixed to each other thereby sealing the connection portion, each of the resin materials comprising a main melting portion and an auxiliary melting portions wherein the main malting portions disposed on the resin materials respectively are melt-fixed to each other as the connection portion pinched between the resin materials and the auxiliary melting portions disposed on the resin materials respectively are formed of material which is compatibilized with the cover portion of the covered wire by the ultrasonic vibration so as to be compatibilized with the cover portion introduced from the connection portion and to be melt-bonded each to other.

The main melting portions may be melt-fixed to each other with the connection portion pinched therebetween so as to seal the connection portion and the auxiliary melting portions may be compatibilized with the cover portion introduced from the melting portions.

The auxiliary melting portions may be melt-fixed to each other.

According to the above connection structure, the members (for example, the covered wires or the covered wire and conductor) are overlapped with each other at the connection portion and the overlapped connection portion is pinched by the resin materials. Then, at the connection portion, the cover portion is melted and removed by ultrasonic vibration and the resin materials are pressed from outside thereof, so that the covered wires or the covered wire and conductor are conductively contacted with each other at the connection portion.

The covered wires introduced from the connection portion is pinched by the auxiliary melting portions and the auxiliary melting portions are pressed and excited. As a result, the auxiliary melting portions and cover portions of the wires are melted and integrated.

Consequently, no gap is produced on the introductive portion of the covered wire from the resin material. Therefore, no water invades in between the cover portion and resin material, so that a high air-tightness is obtained at the connection portion, and waterproofness of the connection portion is improved.

Further, the aforementioned connection structure in which the resin material includes the main melting portion and auxiliary melting portion can be applied to a structure in which the connection portion including overlapped two covered wires pinched by a pair of the resin chips is excited by ultrasonic vibration.

In this case, two covered wires are overlapped with each other at the connection portion, and the overlapped connection portion is pinched by the main melting portions of a pair of the resin chips. Then, at the connection portion, the cover portions are dispersively melted by ultrasonic vibration, and the resin chips are pressed from outside thereof, so that the covered wires are conductively contacted with each other at the connection portions.

By pinching the covered wire introduced from the connection portion by the auxiliary melting portions and then exciting them by ultrasonic vibration, the auxiliary melting portions and the cover portions of the covered wires are melted and integrated. That is, the cover portion of the covered wire which is drawn from the main melting portions and then introduced from the auxiliary melting portions is melted by ultrasonic vibration and integrated with the melted portion of the auxiliary melting portions. As a result, no gap is produced in an introductive portion of the covered wire from the resin chip, so that no water invades in between the cover portion and resin chip, thereby ensuring a high air-tightness in the connection portion and improving the waterproofness therein.

Further, the following structure may be applied. That is, the auxiliary melting portion of one of the pair of the resin chips is formed in convex shape having a wire containing groove for containing the covered wire, and the auxiliary melting portion of the other resin chip is formed in concave shape which has a wire containing groove for containing the covered wire and the one auxiliary melting portion engages. As a result, the covered wire is pinched by the one auxiliary melting portion and the other auxiliary melting portion.

According to this connection structure, the covered wires are contained in the wire containing grooves in the auxiliary melting portions of the other resin chip, and then the auxiliary melting portions are fit to the auxiliary melting portions of the one resin chip. As a result, the cover portions of the wires are also contained in the wire containing grooves of the one resin chip, so that an area of the auxiliary melting portion contacting a circumference of the cover portion of the wire increases. Therefore, when ultrasonic vibration is applied, the cover portions and auxiliary melting portions are melted uniformly.

Further, it is permissible to form the aforementioned main melting portions and portions other than the main melting portions including at least the auxiliary melting portions, integrally with different materials.

In this connection structure, the main melting portions employ resin capable of obtaining a high electrical connection reliability when the connection portion of the covered wire is excited by ultrasonic vibration, and the auxiliary melting portions employ resin compatible with the cover portion of the covered wire. The resin chips are integrally formed with these different resin materials. As a result, the waterproofness can be improved while a reliability in the electrical connection is maintained.

The above described connection structure in which the resin material has the main melting portions and auxiliary melting portions may be applied to a structure in which a connection portion including the covered wire and a conductive terminal portion in a terminal containing portion of a resin housing, which are overlapped with each other, is pinched by the terminal containing portion and resin cover and excited by ultrasonic vibration.

In this case, the covered wire and conductive terminal portion are overlapped with each other at the connection portions. Then, the overlapped connection portions are pinched by the terminal containing portion and cover. The cover portion is melted and removed by ultrasonic vibration, and the cover is pressed from outside thereof. As a result, the covered wire and conductive terminal portion are conductively contacted with each other.

The covered wires introduced from the connection portions are pinched by the auxiliary melting portions and excited by ultrasonic vibration. As a result, the auxiliary melting portions and cover portion of the wires are melted and integrated. Consequently, no gap is produced in the introductive portion of the covered wire from the terminal containing portion. Therefore, no water invades in between the cover portion and terminal containing portion, thereby ensuring a high airtightness in the connection portion and improving waterproofness therein.

Further, it is permissible to construct the connection structure so that terminal containing grooves for containing each of the connection portions are formed in the terminal containing portion and the cover includes connection projections for pinching the connection portions inserted in the containing grooves together with a bottom wall of the terminal containing groove.

According to this connection structure for the covered wires, when the connection portions are contained in the containing grooves and the terminal containing portion is covered with the cover, the connection projections are inserted into the terminal containing grooves. Then, the connection portions are pinched by the bottom wall of the containing groove and connection projections, so that the covered wires and conductive terminal portion are conductively contacted with each other.

Further, the above described connection structure in which the resin material includes the main melting portions and auxiliary melting portions may be applied to a structure in which plural juxtaposed covered wires are overlapped with plural juxtaposed covered wires in a direction intersecting the former covered wires at respective connection portions, and the connection portions are pinched by a pair of resin housings and excited by ultrasonic vibration.

In this case, the plural juxtaposed covered wires are overlapped with plural juxtaposed covered wires in a direction intersecting the former covered wires at the respective connection portions. The overlapped plural covered wires are pinched by a pair of the resin housings and the cover portions are melted and removed by ultrasonic vibration. Then, the resin housing is pressed from outside thereof so that the covered wires are conductively contacted with each other at the respective connection portions.

Further, it is permissible to construct the connection structure so that the cover portions are formed of vinylidene chloride and the auxiliary melting portions are formed of polyester elastomer compatible with vinylidene chloride.

According to this connection structure, the auxiliary melting portions are formed of polyester elastomer compatible with vinylidene chloride. Therefore, the covered wire which is introduced from the connection portion and drawn from the resin material is melt-fixed to the resin material excellently, thereby airtightness in the connection portion being improved.

DETAILED DESCRIPTION OF THE PREFERRED EMBODIMENTS

First Embodiment

Hereinafter, an embodiment of a connection structure for covered wires according to the present invention will be described with reference to the accompanying drawings.

Figure 1:
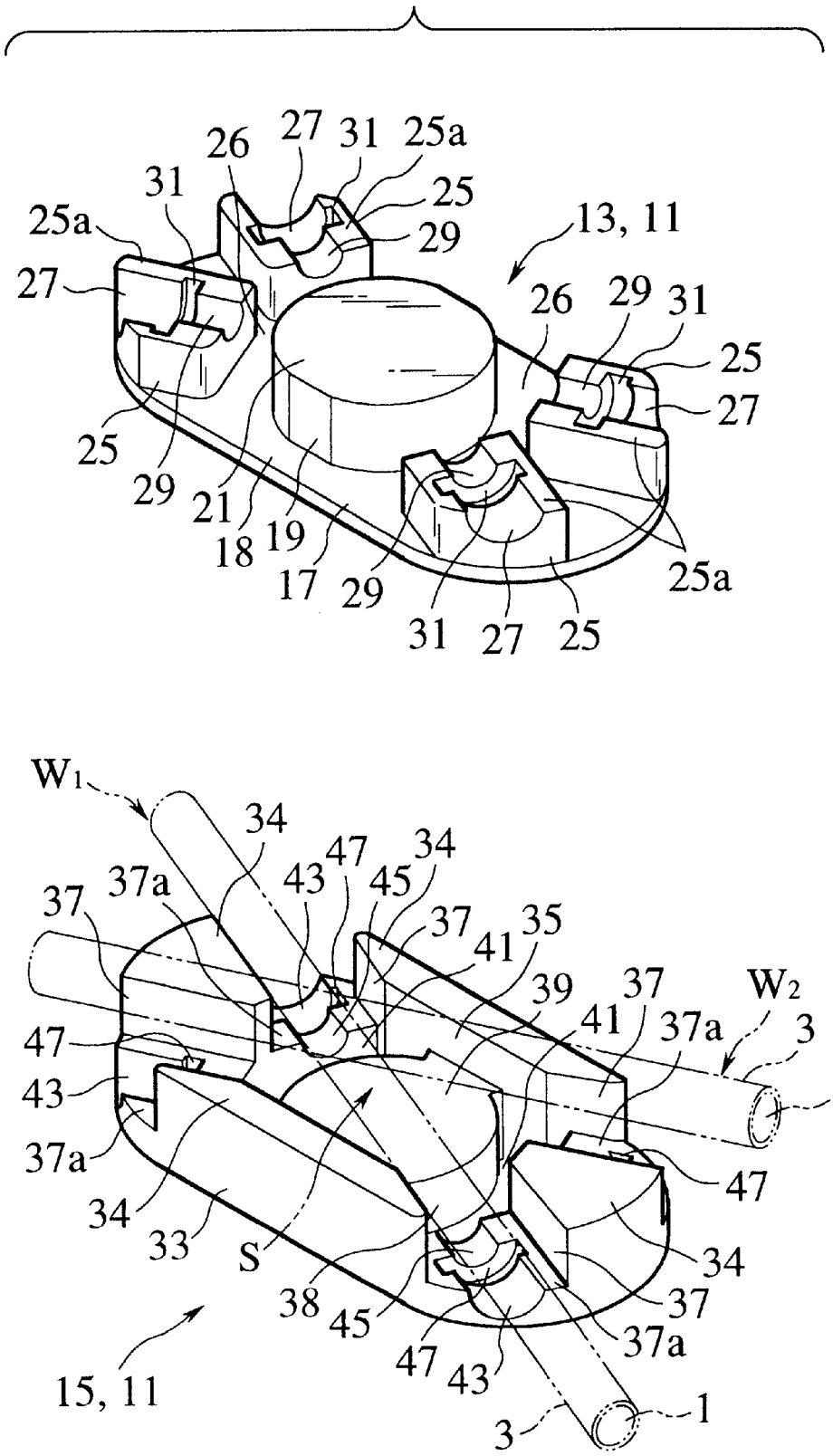
FIG. 1 is a perspective view showing a connection structure for covered wires according to a first embodiment of the present invention, indicating a state in which the upper and lower resin chips are separated.
Figure 2:
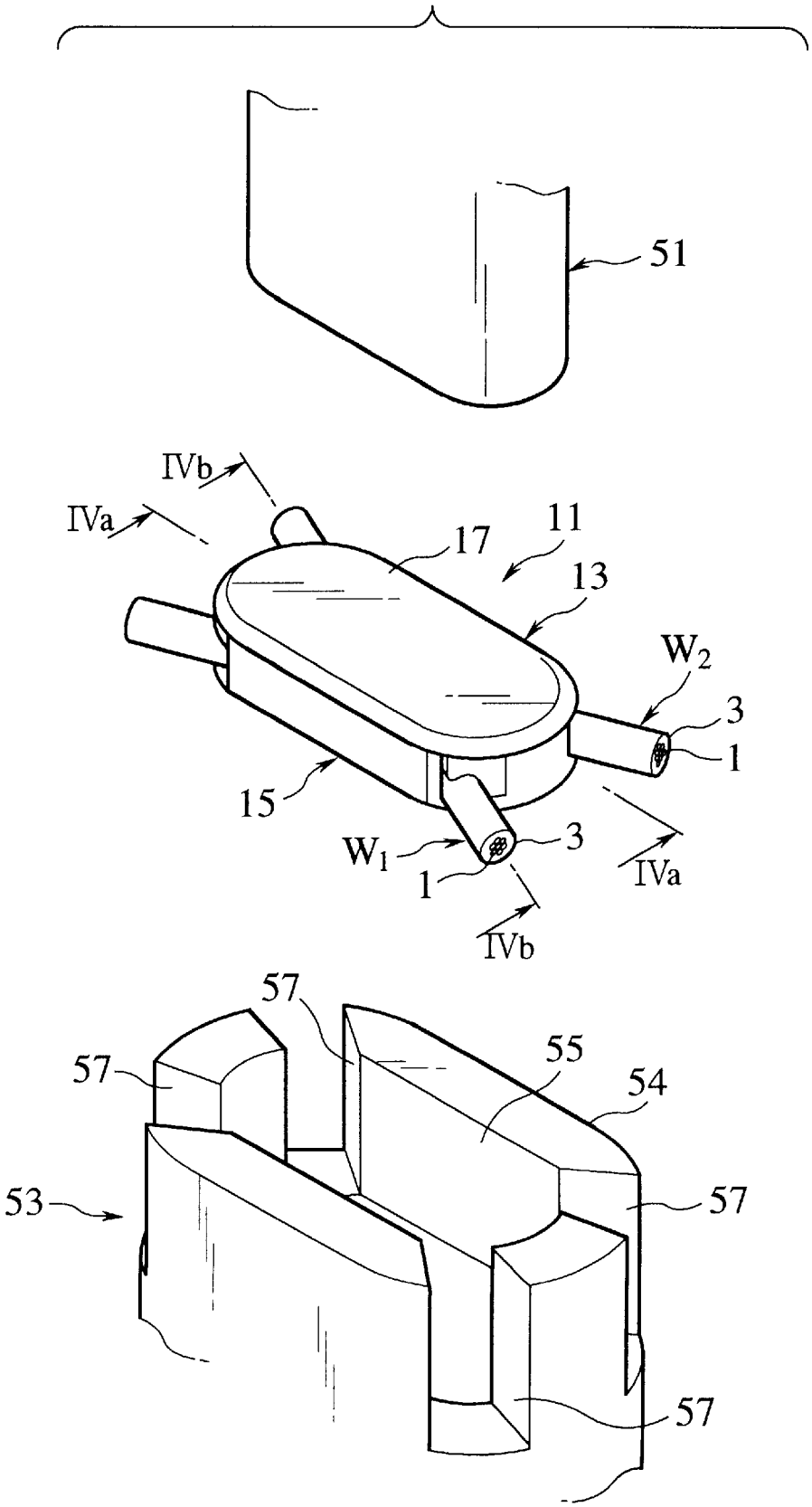
FIG. 2 is a perspective view showing a connection structure for the covered wires according to the first embodiment, indicating a state in which the upper and lower resin chips are fit to each other through the melting faces.
Figure 3A:
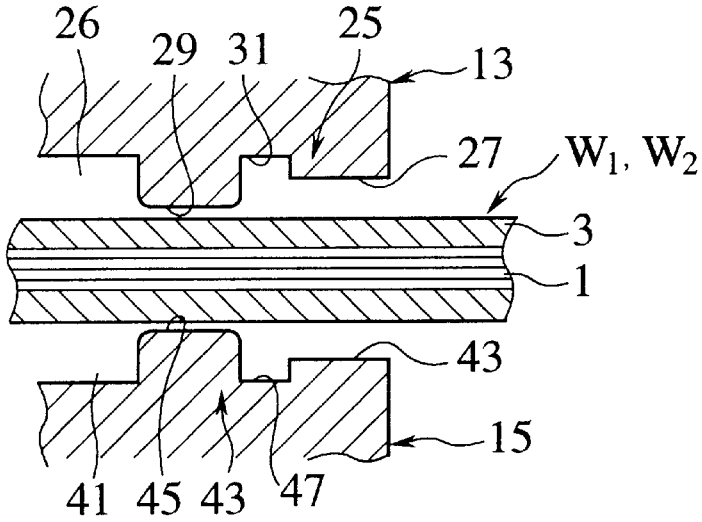
FIG. 3A is a sectional view showing a state (state before resin chips are fit to each other) just after the connection procedure is started, indicating a means for obtaining the connection structure for the covered wires according to the first embodiment.
Figure 3B:
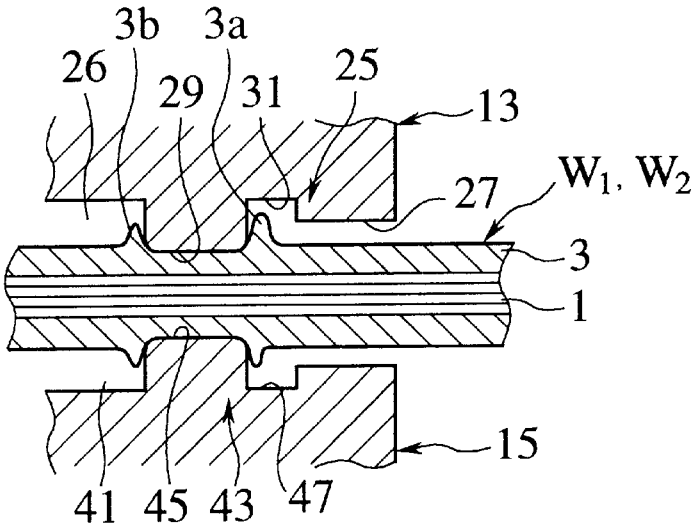
FIG. 3B is a sectional view showing a state (state in which the resin chips are fit to each other) just after the connection procedure is started, indicating a means for obtaining the connection structure for the covered wires according to the first embodiment.
Figure 3C:
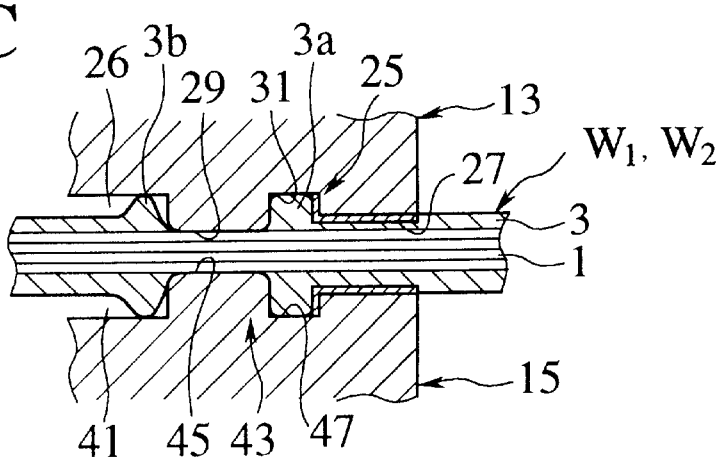
FIG. 3C is a sectional view showing a state (state in which the resin chips are fit to each other and then pressed) just after the connection procedure is started, indicating a means for obtaining the connection structure for the covered wires according to the first embodiment.

FIG. 1 is a perspective view showing a state in which upper and lower resin chips for use in a connection structure for covered wires according to a first embodiment are separated from each other. FIG. 2 is a perspective view showing a state after the connection is completed, showing a means for obtaining the connection structure for the covered wires according to this embodiment. FIG. 3A–3C are sectional views taken along the line IVb—IVb of FIG. 2. FIG. 3A shows a state just before the connection is started. FIG. 3B shows a state of the press-fitting operation. FIG. 3C shows a state after the press-fitting is completed.

In this embodiment, two covered wires W1 and W2 each of which comprises a conductive wire portion 1 and a cover portion 3 which is formed of resin and coated around the outer periphery of the conductive wire portion, are conductively contacted with each other to each other at connection portions thereof as shown in FIG. 1.

For the connection of the two covered wires W1, W2 are used a pair of resin chips 13, 15 serving as a resin material 11, a horn 51 for producing ultrasonic vibration as shown in FIG. 2 and an anvil 53 for supporting the covered wires W1, W2 and the resin chips 13, 15 when the connection between the covered wires is performed.

The anvil 53 includes a base stand (not shown) and a support portion 54 projecting from the base stand. The support portion 54 is designed in a cylindrical shape having a substantially oval cross section. The support portion 54 has a bore portion 55 which is opened at the opposite side to the base stand side (at the upper side in FIG. 1). Two pairs of grooves 57 (four) are formed on the peripheral wall of the support portion 54 so as to cross with each other substantially at the center of the bore portion 55. The four grooves 57 are formed so as to open on the same side as the bore portion 55, extending along the projection direction of the support portion 54 and intercommunicate with one another through the bore portion 55.

As shown in FIG. 1, one (upper) resin chip 13 has a lid body 17 formed in a substantially oval shaped, thin plate having a slightly smaller external periphery than an internal peripheral portion 55 (see FIG. 2) of an anvil 53, a main melting portion 19 formed in a substantially cylindrical shape and four auxiliary melting portions. The main melting portion 19 is provided on an end of a cylinder integrally protruding from a surface 18 of the lid body 17. The auxiliary melting portions 25 are disposed so as to integrally protrude from four corners of the surface 18 of the lid body 17. The main melting portion 19 is disposed substantially in the center of the surface 18 of the lid body 17.

A gap portion 26 for separating the main melting portion 19 and the auxiliary melting portions 25 is provided between the main melting portion 19 and the auxiliary melting portions 25. The main melting portion 19 has a main melting surface 21 which pinches the connection portion S with a main melting surface 39 of a lower resin chip 15 described later, such that the main melting surface 21 is melted together with the lower main melting surface 39. The auxiliary melting portions 25 have upper auxiliary melting surfaces 25*a* which are melted together with lower auxiliary melting surfaces 37*a* described later.

The other (lower) chip 15 has a chip body 33 formed in a substantially oval shaped, thick plate having a slightly smaller outer periphery than the internal peripheral portion 55 (see FIG. 2) of the anvil 53 like the upper resin chip 13, a lower main melting surface 38 formed in a substantially cylindrical shape corresponding to the upper main melting portion 19, and lower auxiliary melting portions 37 provided corresponding to the upper auxiliary melting portions 25. The lower auxiliary melting portion 37 is a groove structure formed in a concave shape on a surface 34 on a side (upper side in FIG. 1) of the chip body 33 such that the upper auxiliary melting portion 25 is contained therein when the upper and lower resin chips 13, 15 are fit together. A bottom surface of the lower auxiliary melting portion 37 forms the aforementioned lower auxiliary melting surface 37*a*.

A lower main melting portion 38 is formed below the surface 34 of the chip body 33 such that its surface opposes the aforementioned upper main melting surface 21 when the upper and lower resin chips 13, 15 are fit together. A gap portion 41 for separating the main melting portion 38 and the auxiliary melting portion 37 is disposed between the main melting portion 38 and the auxiliary melting portion 37. By this gap portion 41, the main melting portion 38 is separated and formed in a substantially same cylindrical shape as the upper side.

The respective auxiliary melting portions 25, 37 have cover portion removing portions 29, 45 for melting the cover portion 3 pinched by the auxiliary melting portions 25, 37 and pushing it out in a direction of the extension of the covered wire 3 and waterproofing groove portions 31, 47 in which the pushed cover portion 3 is filled and hardened. The upper and lower auxiliary melting surfaces 25*a*, 37*a* have concave wire containing grooves 27, 43 having a semi-circular shaped internal surface having substantially same diameter as the external diameter of the covered wires W1, W2. The aforementioned cover portion removing portions 29, 45 are disposed so as to protrude from the internal surface of the wire containing grooves 27, 43. The aforementioned waterproofing groove portions 31, 47 are disposed so as to dent from the internal surface of the wire containing grooves 27, 43 along the external surfaces of the covered wires W1, W2.

The waterproofing groove portions 31, 47 are disposed adjacent to a counterside of the main melting portions relative to the cover portion removing portions 29, 45 and formed in a smaller volume than that of the cover portion 3*a* pushed out. The waterproofing groove portions 31, 47 may be provided on not only a single side relative to the cover portion removing portions 29, 45 but also both sides thereof.

As shown in FIG. 2, the bottom portion of the horn 51 is formed so as to be of a substantially oval shape having substantially the same or slightly smaller outer periphery than that of the resin chips 13, 15 (lid body 17, chip body 33).

As for material of the resin chips 13, 15, the main melting portions 19, 38 are made of acrylic resin, ABS (acrylonitrile-butadiene-styrene copolymer) resin, PC (polycarbonate) resin, PVC (polyvinyl chloride) resin, PE (polyethylene) resin, PEI (polyetherimide), PBT (polyethylene terephtalate) or the like. Generally, the material of the main melting portions 19, 38 is harder than vinyl chloride used for the cover portion 3. With respect to the suitability of these resins for use as the resin chips 13, 15, applicability can be recognized in all the resins in term of conductivity and conductive stability, and if judging from appearance and insulation property as well, particularly PEI resins and PBT resins are suitable for the resin chip.

When polyester or elastomer is used, PBT is most suitable as resin for the connection portion. Because the chemical constitution of polyester or elastomer is block copolymer of PBT and polyether, it is easy to obtain compatibility between the material of resin and that of the cover portion 3 of the wire.

The chip body 33 and the lid body 17 including the auxiliary melting portions 25, 37 except the main melting portions 19, 38 utilize resin (elastomer: material having the same characteristics as synthetic rubber or synthetic plastic, which has such a property that under the ambient temperature, it is stretched double its initial length by a low stress and when the stress is released, it is immediately restored to the original length) having compatibility with the material of the cover portion 3.

Resins having compatibility with the cover portion 3 include, for example, (1) ABS/vinylidene chloride alloy (acrylonitrile-butadiene-styrene copolymer/vinylidene chloride), (2) acrylic/vinylidene chloride alloy (acrylonitrile/vinylidene chloride), (3) polyester elastomer and the like. Particularly, block copolymer of polyester elastomer or the like (e.g., polybutylene terphthalate) with polyether is preferred.

Compatibility indicates a degree of being compatible with other agent and refers particularly to a plasticizing material's mixing equally with polymeric material. This is expressed by a limit amount inhibiting phase separation when plasticizing material is added to polymeric material.

When the resin chips 13, 15 are formed, the main melting portions 19, 38, the chip body 33 containing the auxiliary melting portions 25, 37 excluding the main melting portions 19, 38 and the lid body 17 are molded in two-color-part molding manner with different materials and then integrated.

Next, a procedure for conductively making two covered wires W1, W2 into contact with each other at the connection portions S and a procedure for sealing the resin chips 13, 15 at the connection portions S will be described.

In order to connect the two covered wires W1 and W2 to each other, both of the covered wires W1 and W2 are overlapped with each other at the connection portions S thereof, and the overlapped connection portions S are pinched by the pair of the resin chips 13, 15 from up and down so as to include portions extending from the connection portions S in the wire containing grooves 27, 43. Specifically, one of the resin chips (the resin chip 15 at the lower side) is inserted into the bore portion 55 of the anvil 53 such that one surface 34 is directed upward. Then, one of the covered wires (the covered wire W1) is inserted into the confronting wire containing groove 47 from the upper side of the inserted resin chip 15. Then, the other covered wire W2 is inserted into the other confronting wire containing grooves 47. Finally, the other (upper) resin chip 13 is inserted into the bore portion 55 with one surface 18 directing downward such that the respective wire containing grooves 27 coincide with the covered wires W1 and W2. Both the covered wires W1, W2 are arranged in the bore portion 55 such that the connection portions S thereof cross each other at the center of the main melting surfaces 21, 39. Through this arrangement, the connection portions S are pinched by the main melting surfaces 21, 39 of the upper and lower resin chips 13, 15 such that the overlapping connection portions S are located substantially at the center of the main melting surfaces 21, 39.

Subsequently, the cover portions 3 at the connection portions S of the covered wires are melted so as to be dispersed by ultrasonic vibration. The conductive wire portions (core) 1 of the covered wires W1, W2 are conductively contacted with each other at the connection portions S thereof by pressing the covered wires from the outside of the resin chips 13, 15. Thereafter, the pair of the resin chips 13, 15 are mutually melted at the melting surfaces 21, 39, the auxiliary melting surfaces 25*a*, 37*a*, and the one surfaces 18, 34 to seal the connection portions S.

Specifically, the horn 51 is inserted into the bore portion 55 from the upper side of the finally-inserted upper resin chip 13 and placed on the upper resin chip 13 to excite and press the connection portion S from the outside of the upper and lower resin chips 13, 15 between the horn 51 and the anvil 53. The press of the connection portion S is performed by pressing the horn 57 toward the anvil 53, and the press direction is coincident with the overlapping direction of the covered wires.

When the resin materials 11 are melt-fixed to each other by the ultrasonic vibration, the excitation is preferably performed in a direction which substantially perpendicularly intersects the connection surface of the resin materials 11 because it provides the most excellent melt-fixing state. Therefore, the direction of the excitation of the connection portion S is set to a direction which crosses the confronting main melting surfaces 21, 39, the auxiliary melting surfaces 25*a*, 37*a*, and the one surfaces 18, 34 of the resin chips 13, 15, that is, it is set to be coincident with the overlapping direction of the covered wires W1, W2. W1th this arrangement, longitudinal vibration is produced from the horn 51.

When the connection portions S are pressed and excited in the above state, the cover portions 3 are first melted and the conductive wire portions 1 of the covered wires W1, W2 are exposed at the connection portion S between the main melting surfaces 21 and 39.

At this time, the melted cover portions 3 are extruded from the center side of the main melting surfaces 21, 39 toward the outside thereof because the connection portions S are pressed from the upper and lower sides, so that the conductive wire portions 1 are more excellently exposed and surely conductively contacted with each other.

Like the press direction, the direction of the excitation for the connection portions S is set to be coincident with the overlapping direction of the covered wires W1, W2, so that the action of extruding the melted cover portions 3 from the center side of the main melting surfaces 21, 39 to the outside thereof is promoted.

When the pressing and exciting operation on the connection portions S is further continued after the melting of the cover portions 3, the main melting portions 19, 38 are melted so that the main melting surfaces 21, 39 are melted to each other. In addition, the cover portions 3 in the vicinity of the conductive wire portion 1 are melted to the outer peripheral surface portion of the main melting portions 19, 38. W1th this operation, the outer peripheral portions of the conductively- contacted conductive wire portions 1 of the connection portions S are kept to be coated with the main melting portions 19, 38.

When the resin chips 13, 15 are melted together, the upper auxiliary melting portions 25 are put into the lower auxiliary melting portions 37 formed in a groove shape. As shown in FIG. 3, the cover portions 3 of the covered wires W1, W2 introduced from the main melting portions 19, 38 are pinched by the cover portion removing portions 29, 45 of the auxiliary melting portions 25, 43 and the auxiliary melting surfaces 25*a*, 37*a* are melted together. Then the pinched cover portions 3 are melted by the cover portion removing portions 29, 45 and extruded out along a direction of the extension of the covered wires W1, W2 (see FIG. 3B). The extruded cover portions 3*a* are filled in the waterproofing groove portions 31, 47 and hardened (see FIG. 3C). Consequently, at the auxiliary melting portions 25, 43 which introduce the covered wires W1, W2 from the resin chips 13, 15, the extruded cover portions 3*a* are hardened annually integrally with an outer peripheral surface of the cover portions 3 remaining in the waterproofing groove portions 31, 47, such that they function in the same manner as an elastic packing.

The aforementioned pinched cover portions 3 are extruded inside as well in the direction of the extension of the covered wires W1, W2 (see FIG. 3B) by the cover portion removing portions 29, 45. The extruded cover portions 3*b* are contained in gap portions 26, 41 such that they are hardened annually integrally with an outer peripheral surface of the remaining cover portions 3. Then, the extruded cover portions 3*b* exert the same function as an elastic packing like the waterproofing groove portions 31, 47.

When the resin chips 13, 15 are melted together, the main melting portions 19, 38, the auxiliary melting surfaces 25*a*, 37*a* and the one surfaces 18, 34 are melt-bonded and melt-fixed each other. The gap portions 26, 41 which separate the main melting portions 19, 38 from the auxiliary melting portions 25, 37 form a sealed space in the melt-fixed resin chips 13, 15. Consequently, the connection portions S conductively contacted with each other are sealed by the main melting portions 19, 38. At the same time, the lid body 17 and the chip body 33 also form a sealing space (gap portions 26, 41) so that the connection portions S are sealed in double formations.

Figure 4A:
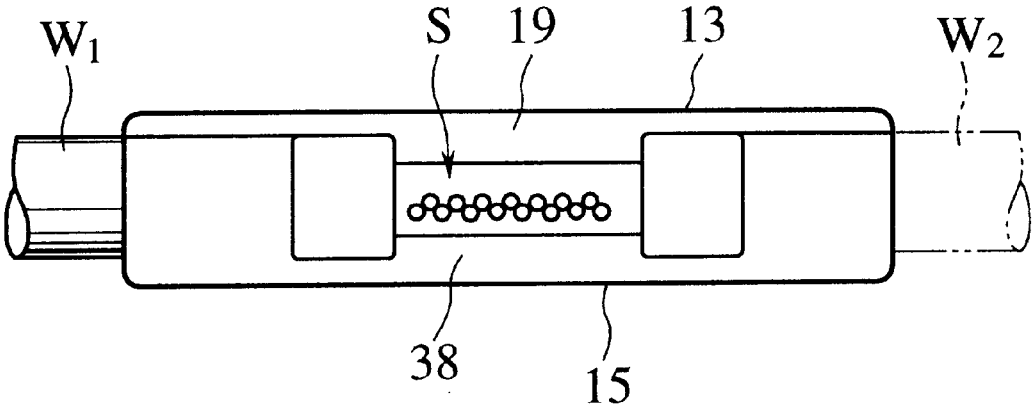
FIG. 4A is a sectional view taken along the line IVa—IVa of FIG. 2.
Figure 4B:
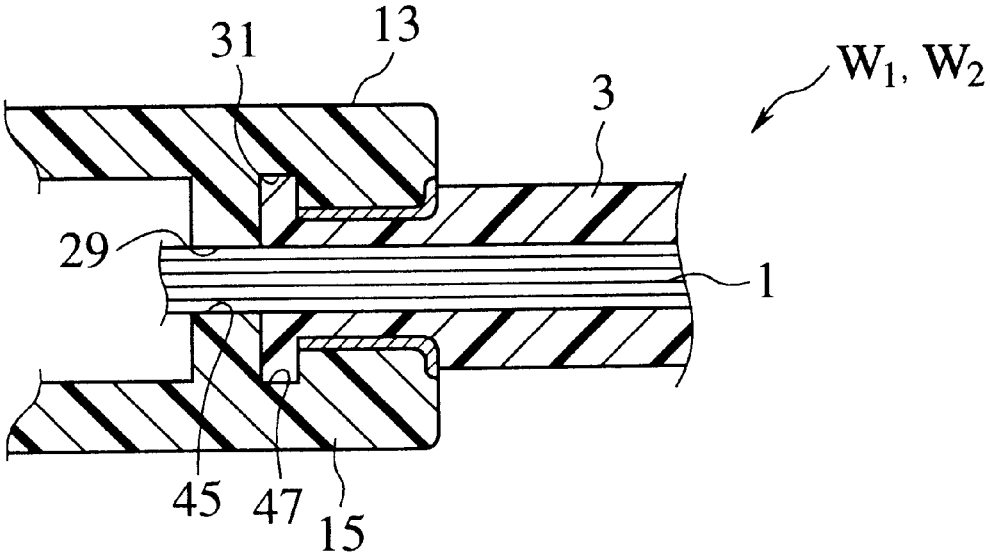
FIG. 4B is a sectional view taken along the line IVb—IVb of FIG. 2.

According to this embodiment, because the auxiliary melting portions 25, 37 are formed of material having compatibility with the cover portion 3, as shown in FIG. 4B, the auxiliary melting portions of the upper and lower resin chips 13, 15 and cover portions 3 are melted so as to be integrated with each other at exits of the covered wires W1, W2 from the resin chips 13, 15 by means of pressing and excitation. As a result, an interior of the connection portions S is sealed completely.

According to the connection structure of this embodiment, the covered wires W1, W2 are overlapped with each other at the connection portions S thereof and the connection portions S are pinched by a pair of the resin chips 13, 15. In this state, the cover portions 3 of the covered wires are dispersively melted while being pressed from the outside of the resin chips 13, 15, whereby the covered wires W1, W2 can be conductively contacted with each other. Thus, it is not required that the cover portion 3 are beforehand removed from the covered wires to connect the conductive wire portions of the covered wires to each other, and thus the conductive connection between the covered wires can be performed with a simple connection work.

After the covered wires W1, W2 are conductively contacted with each other at the connection portions S thereof, the upper and lower resin chips 13, 15 are melt-fixed to seal the connection portions S. Therefore, the high mechanical strength can be obtained at the connection portions S by the resin chips 13, 15 which are melted and hardened around the connection portions S. Then, because the connection portions S are sealed by the resin chips 13, 15, it is possible to secure a sufficient insulation property.

Accordingly, the conductivity characteristic between the covered wires W1 and W2 at the connection portions S thereof can be stabilized by the high mechanical strength and the sufficient insulation.

The connection structure according to this embodiment can be obtained by such a relatively simple method that the overlapped connection portions S thereof are pinched by the resin chips 13, 15 and the connection portions S are pressed and excited between the horn 51 and anvil 53 from the outside of the resin chips 13, 15. Further, according to this embodiment, one covered wire W1 and mating member to be conductively contacted therewith (the other covered wire W2 in this embodiment) are not restricted to any particular shape. Therefore this connection structure can be applied to connection between the covered wires W1, W2 and a terminal or the like thereby ensuring a high general purpose property.

Furthermore, the covered wires W1, W2 are pinched by a pair of the resin chips 13, 15 from the upper and lower sides of the covered wires in the overlapping direction, and then the connection portions S of the covered wires are pressed and excited from the outside of the resin chips 13, 15 between the horn 51 and the anvil 53. In this case, the press direction is set to be coincident with the overlapping direction of the covered wires W1, W2. Therefore, when the connection portions S are pressed, the melted cover portions 3 are extruded from the center of the resin chips 13, 15 toward the outside thereof and the conductive wire portions 1 are exposed excellently, so that the conductive wire portions can be surely conductively contacted with each other. Furthermore, like the press direction, the direction of the excitation of the connection portions S is set to be coincident with the overlapping direction of the covered wires W1, W2, so that the resin chips 13, 15 can be kept in good melt-fixing state, and the action of extruding the melted cover portions 3 can be promoted.

At the auxiliary melting portions 25, 43 which introduce the covered wires W1, W2 outside from the resin chips 13, 15, the extruded cover portions 3*a* are hardened annually integrally with the outer peripheral surface of the remaining cover portion 3 in the waterproofing groove portions 31, 47 and serves the same function as an elastic packing. Therefore, the conductive wire portions 1 of the covered wires W1, W2 at the introducing portions from the resin chips 13, 15 are covered with the cover portions 3 remaining in the waterproofing groove portions 31, 47. Further, the extruded cover portions 3*a* functioning as the elastic packing prevents an invasion of water or like into the resin chips 13, 15 from outside.

Further, because the auxiliary melting portions 25, 37 and the one surfaces 18, 34 as well as the main melting portions 19, 38 are melt-fixed, the melting area of the resin chips 13, 15 increases. Therefore, the melting force between the resin chips 13 and 15 can be increased while limiting the pressing and excitation force by the horn 51 not so as to be excessive, so that the higher mechanical strength can be obtained.

Consequently, it is possible to achieve enhancement of the melting force between the resin chips 13 and 15 and improvement of the covering performance (enhancement of waterproof) for the conductive wire portion 1 by the resin chips 13, 15.

Further, because the waterproofing groove portions 31, 47 are formed in a smaller volume than that of the extruded cover portion 3*a*, the shape of the cover portions 3*a* to be extruded and hardened can be formed to the same one as the groove shape of the waterproofing groove portions 31, 47.

Further, because the waterproofing groove portions 31, 47 are provided at the counterside of the main melting portion relative to the cover portion removing portions 29, 45, the cover portions 3*a* which are hardened in the waterproofing groove portions 31, 47 and serve the same function as an elastic packing can be provided on the counterside of the main melting portion, in which the covered wires W1, W2 are introduced from the resin chips 13, 15.

Further, the conductively contacted connection portions S are sealed by the main melting portions 19, 38 and further sealed by a space formed by the melting of the lid body and chip body such that the connections portions S are sealed in double fashion. Consequently, a further secure waterproof property can be obtained.

When the resin chips 13, 15 are melt-fixed with the connection portions S pinched thereby, the melted cover portion removing portions 29, 45 are charged in between the cores, so that gap portions formed between the cover portion 3 of the covered wires W1, W2 and core wires, and between the core wires can be filled with the resin material 11. As a result, waterproof effect can be obtained inside of the covered wires W1, W2. Therefore, for example, in a case where one end of the covered wires W1, W2 is connected to a member needing waterproof (waterproofed member) and the other end thereof is connected to a member which functionally needs no waterproof (non-waterproofed member), even when water invades into the covered wires W1, W2 from the other end thereof due to the capillary phenomenon and flows through the covered wires W1, W2, the flowing of water to the end of the covered wire can be prevented by the aforementioned waterproof effect. Therefore, the waterproof of the one end side of the covered wire can be kept without subjecting the other end of the covered wire to the waterproof treatment.

That is, when both ends of the covered wires W1,W2 are connected to a waterproof member and a non-waterproof member respectively, the waterproof property can be kept for the waterproof member by the simple and low-cost method and structure without subjecting the non-waterproof member to the waterproof treatment. Meanwhile, in this case, it is more advantageous to use the resin chips 13, 15 having a relatively low viscosity at the time of melting.

Although, in the aforementioned embodiment, the auxiliary melting portions 25, 37 are provided with the cover portion removing portions 29, 45 and the waterproof groove portions 31, 47, the present invention can be applied to a connection structure in which the auxiliary melting portions 25, 37 are not provided with the cover portion removing portions 29, 45 and the waterproof groove portions 31, 47.

Second Embodiment

A second embodiment of the present invention will be described with reference to FIGS. 5–7. This embodiment shows a case in which the connection structure for the covered wires according to the present invention is applied to terminals 66 and covered wires 68 contained within a connector housing 60.

Figure 5:
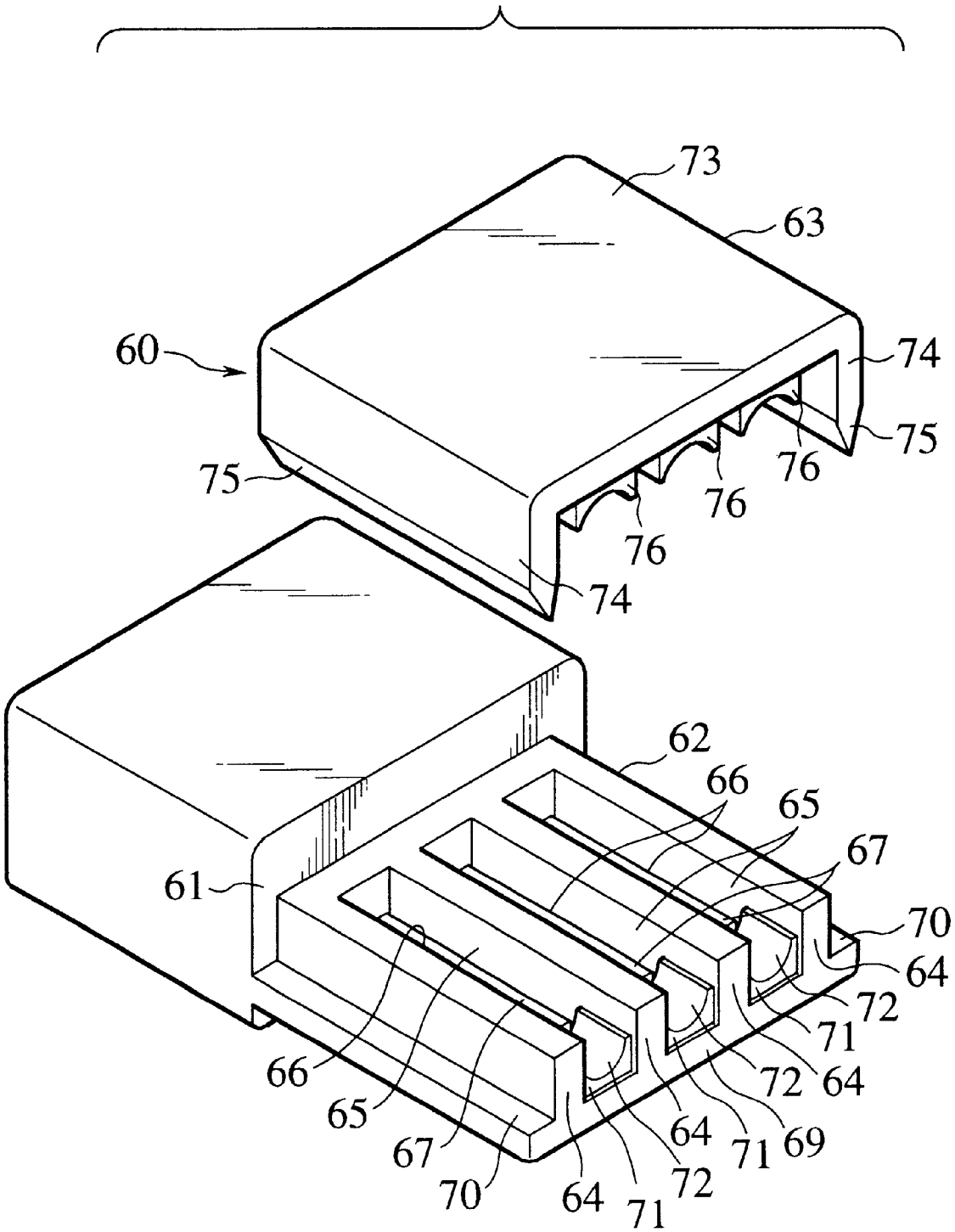
FIG. 5 is a disassembly perspective view showing a connector housing and cover according to a second embodiment of the present invention.

In the connector housing shown in FIG. 5, a terminal containing portion 62 is integrally formed at a rear end of a housing body 61. This terminal containing portion 62 is closed by a cover 63. The terminal containing portion 62 is divided by four partition walls 64, 64, 64, 64 to three terminal containing grooves 65, 65, 65. The terminal containing grooves 65, 65, 65 include connection portions 78 in which sheet-like terminal portions 67 of the terminals 66 and end portions 68*a* of the covered wires 68 (see FIG. 7A) contained in the connector housing 60 are overlapped with each other.

Outside of the partition walls 64, 64 on both ends extend bottom walls 69 of the terminal containing grooves 65 so as to form main melting portions 70, 70 of the housing body 61. Further at openings on rear ends of the respective terminal containing grooves 65 are provided auxiliary melting portions 71, 71, 71 of the housing body 61. In the middle of the auxiliary melting portions 71 are formed wire containing grooves 72 each having an arc cross section in which half of an external circumference of a covered wire 68 is contained.

Figure 6:
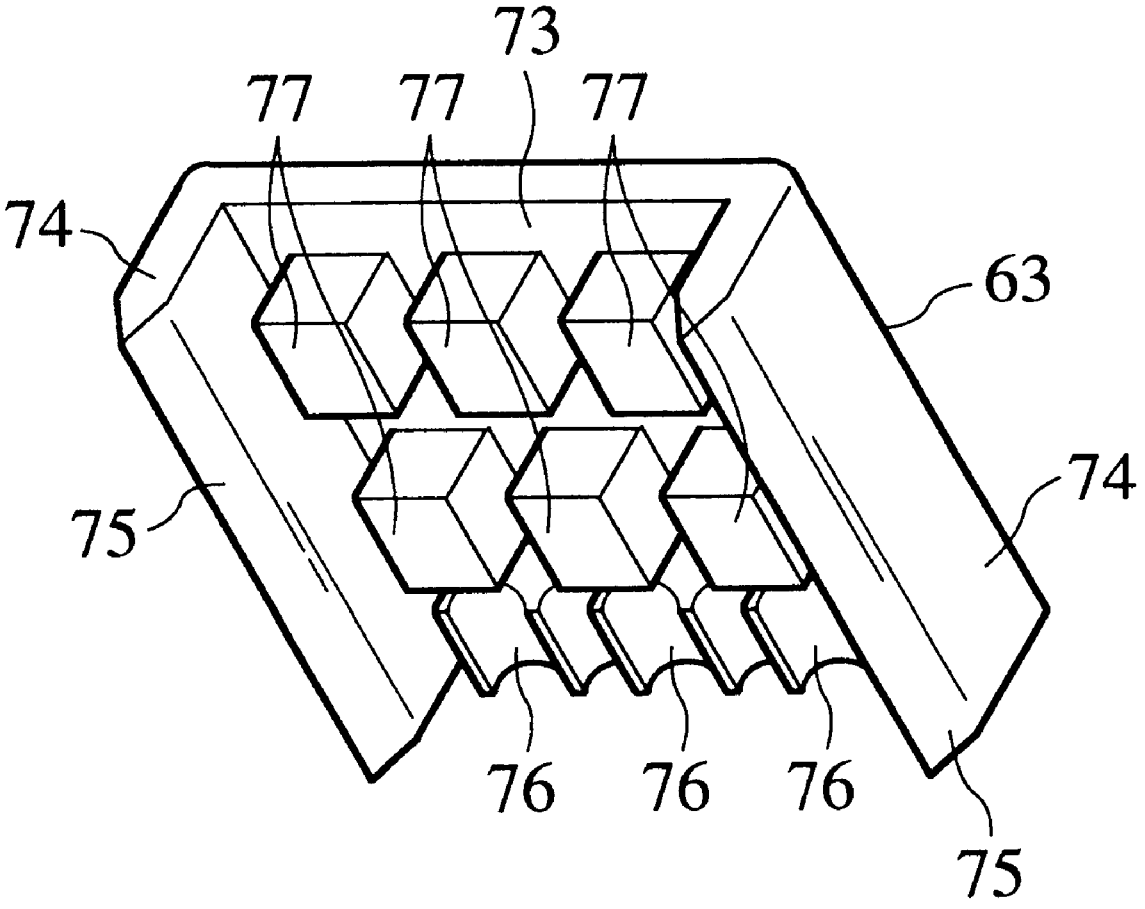
FIG. 6 is a perspective view showing a rear side of the cover according to the second embodiment.

On the other hand, as shown in FIG. 6, the cover 63 comprises an enclosed plate portion 73 and a pair of side walls 74, 74 extending from both ends of the enclosed plate portion 73 in the same direction thereby providing a U-shaped cross section. As shown in FIG. 6, inside the enclosed plate portion 73 are provided three columns of connection projections 77, 77, 77 corresponding to each of the terminal containing grooves 65 such that they project therefrom. Further, the main melting portions 75, 75 formed at an sharp angle are provided at ends of the pair of the side walls 74, 74. The main melting portions 75, 75 make contact with the main melting portions 70, 70 of the housing side when the terminal containing portion 62 is closed by the cover 63. Further, the enclosed plate portion 73 includes auxiliary melting portions 76, 76, 76 corresponding to the auxiliary melting portions 71, 71, 71 of the housing side. The auxiliary melting portions 76 also have wire containing grooves.

As for material of the connector housing 60 and cover 63, at least the main melting portions 70, 75 are made of acrylic resin, ABS (acrylonitrile-butadiene-styrene copolymer) resin, PC (polycarbonate) resin, PVC (polyvinyl chloride) resin, PE (polyethylene) resin, PEI (polyetherimide), PBT (polyethylene terephtalate) or the like. Generally, the material of the main melting portions 70, 75 is harder than vinyl chloride used for the cover portion 68*b*. W1th respect to the suitability of these resins for use as the connector housing 60 and cover 63, applicability can be recognized in all the resins in term of conductivity and conductive stability, and if judging from appearance and insulation property as well, particularly PEI resins and PBT resins are suitable for the connector housing and cover.

When polyester or elastomer is used, PBT is most suitable as resin for the main melting portions 70, 75. Because the chemical constitution of polyester or elastomer is block copolymer of PBT and polyether, it is easy to obtain compatibility between the material of the connector housing and cover, and that of the cover portion 3 of the wire.

The auxiliary melting portions 71, 76 utilize resin (elastomer: material having the same characteristics as synthetic rubber or synthetic plastic, which has such a property that under the ambient temperature, it is stretched double its initial length by a low stress and when the stress is released, it is immediately restored to the original length) having compatibility with the material of the cover portion 68*b*. Resins having compatibility with the cover portion 68*b* include, for example, (1) ABS/vinylidene chloride alloy (acrylonitrile-butadiene-styrene copolymer/vinylidene chloride), (2) acrylic/vinylidene chloride alloy (acrylonitrile/vinylidene chloride), (3) polyester elastomer and the like. Particularly, polyester elastomer or the like is preferred.

Compatibility indicates a degree of being compatible with other agent and refers particularly to a plasticizing material's mixing equally with polymeric material. This is expressed by a limit amount inhibiting phase separation when plasticizing material is added to polymeric material.

When the connector housing 60 and cover 63 are formed, the main melting portions 70, 75 and portions other than the main melting portions 70, 75 are integrally formed with different materials.

Next, a procedure for conductively making the covered wires 68 into contact with the terminals 66 contained within the connector housing 60 will be described.

First, the terminals 66 are contained within the connector housing 60 such that the sheet-like terminal portions 67 are disposed within each of the terminal containing grooves 65. Next, the covered wires 68 are inserted into each of the terminal containing grooves 65 and the end portions thereof are placed on the terminal portions 67. W1th this condition, the terminal containing portion 62 is covered with the cover 63. At this time, the main melting portion of the cover 63 make contact with the main melting portion 70 of the housing such that the connection projections 77 are inserted into the respective terminal containing grooves 65 and the make contact with the connection portions 78 of the end portions of the covered wires 68 on the terminal portions 67. Then, the connection portions 78 are pinched between the connection projections 77 and bottom walls 69 of the terminal containing grooves 65.

The covered wires 68 drawn from the connection portions 78 are placed on the auxiliary melting portions 71 of the housing side and pinched by the auxiliary melting portions 71 of the housing side and that of the cover 63.

Figure 7A:
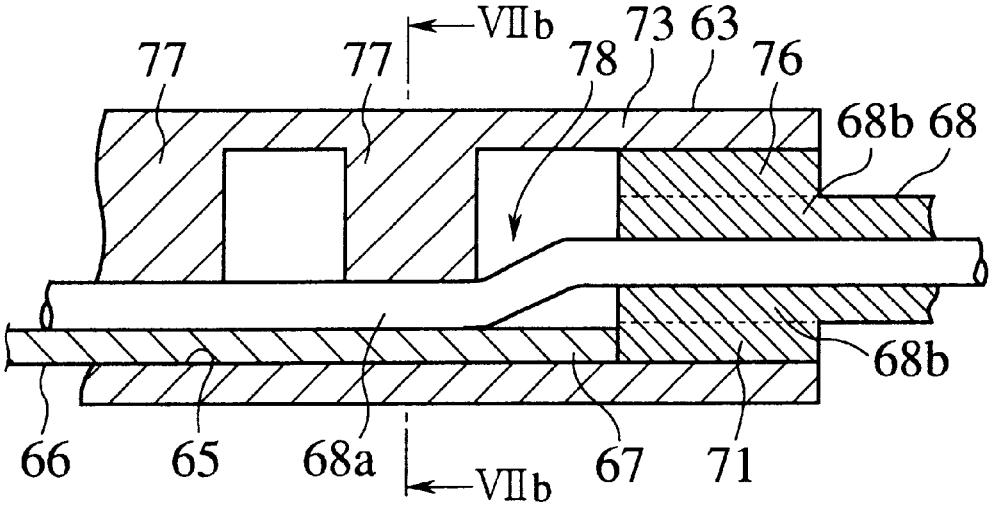
FIG. 7A is a sectional view showing the connection portion according to the second embodiment.
Figure 7B:
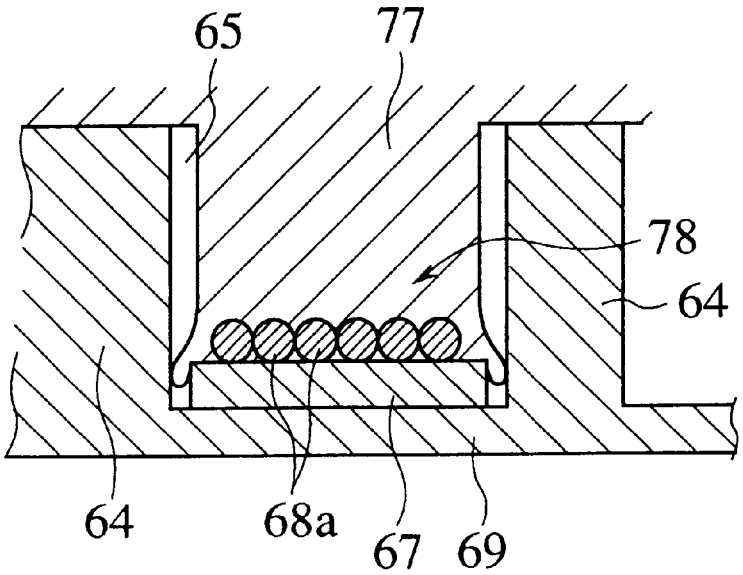
FIG. 7B is a sectional view taken along the line VIIb—VIIb of FIG. 7A.

Then, while the cover 63 is pressed to the terminal containing portion 62, the cover 63 and terminal containing portion 62 are excited by ultrasonic vibration. When the cover 63 is pressed and excited, the cover portions 68*b* of the covered wires 68 placed on the terminal portion 67 are melted and removed. Then, as shown in FIGS. 7A, 7B, when the cover 63 is pressed, the core portions of the covered wires 68 are pressed by the connection projections 77 and make contact with the terminal portion 67. As a result, the covered wires 68 are electrically connected to the terminal portions 67. Further, the main melting portions 70, 75 are melt-fixed to each other by ultrasonic vibration so that the cover 63 is fixed to the connector housing 60 while covering the terminal containing portion 62. The auxiliary melting portions 71, 76 are melt-bonded and/or melt-fixed each other and compatibilized with the cover portions 68*b* of the covered wires 68 by ultrasonic vibration so that they are integrated with each other.

Because, according to this embodiment, the auxiliary melting portions 71, 76 are formed of material compatible with the cover portion 68*b* of the covered wire 68, the auxiliary melting portions 71, 76 and the cover portions 68*b* are melted and integrated at introduction portions of the covered wires 68 from the connection portions 78. Therefore, the connection portions 78 can be securely sealed without producing a gap between the cover portion 68*b* and the auxiliary melting portions 71, 76.

Third Embodiment

Figure 8:
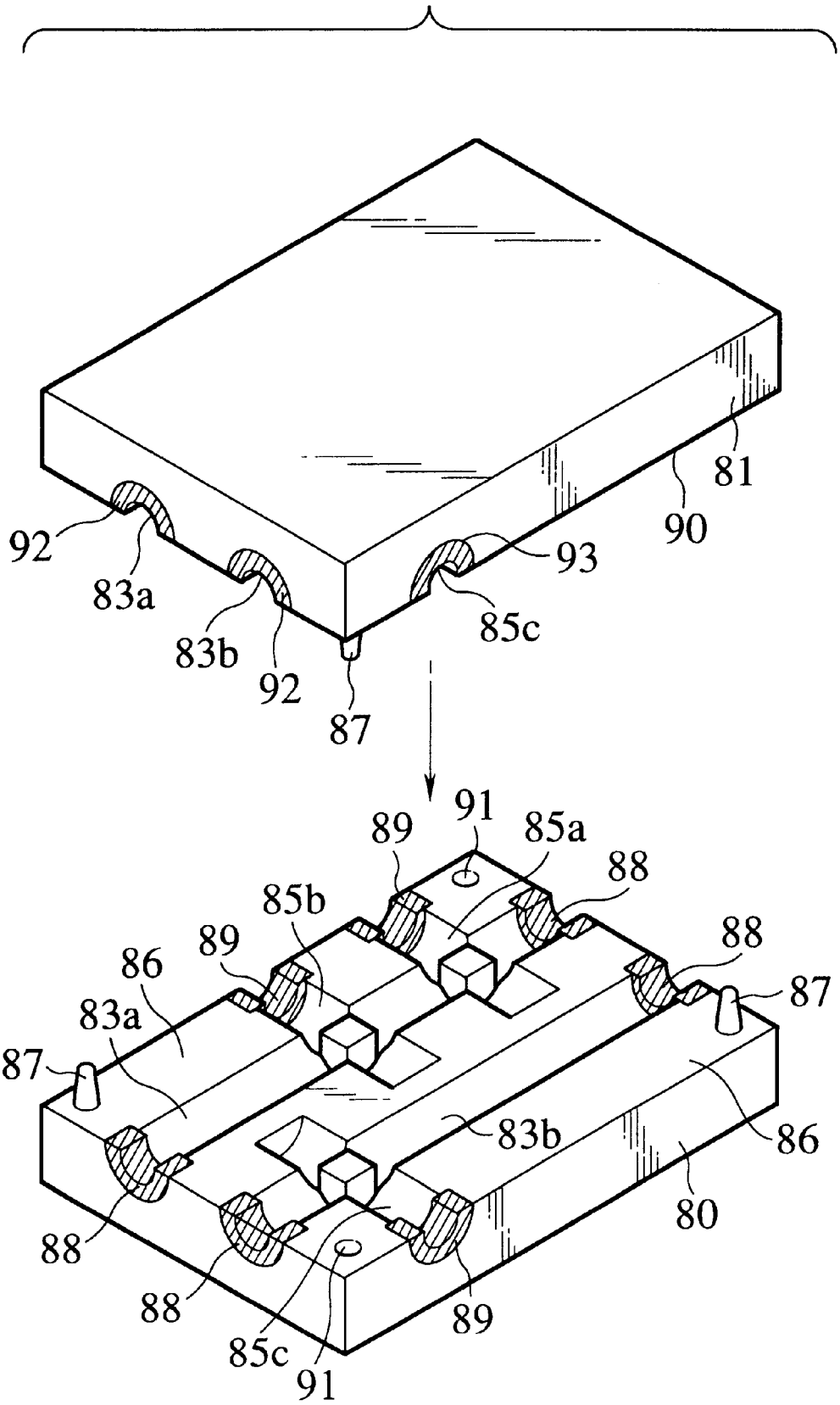
FIG. 8 is a perspective view showing resin housings used for a matrix joint according to a third embodiment of the present invention.
Figure 9:
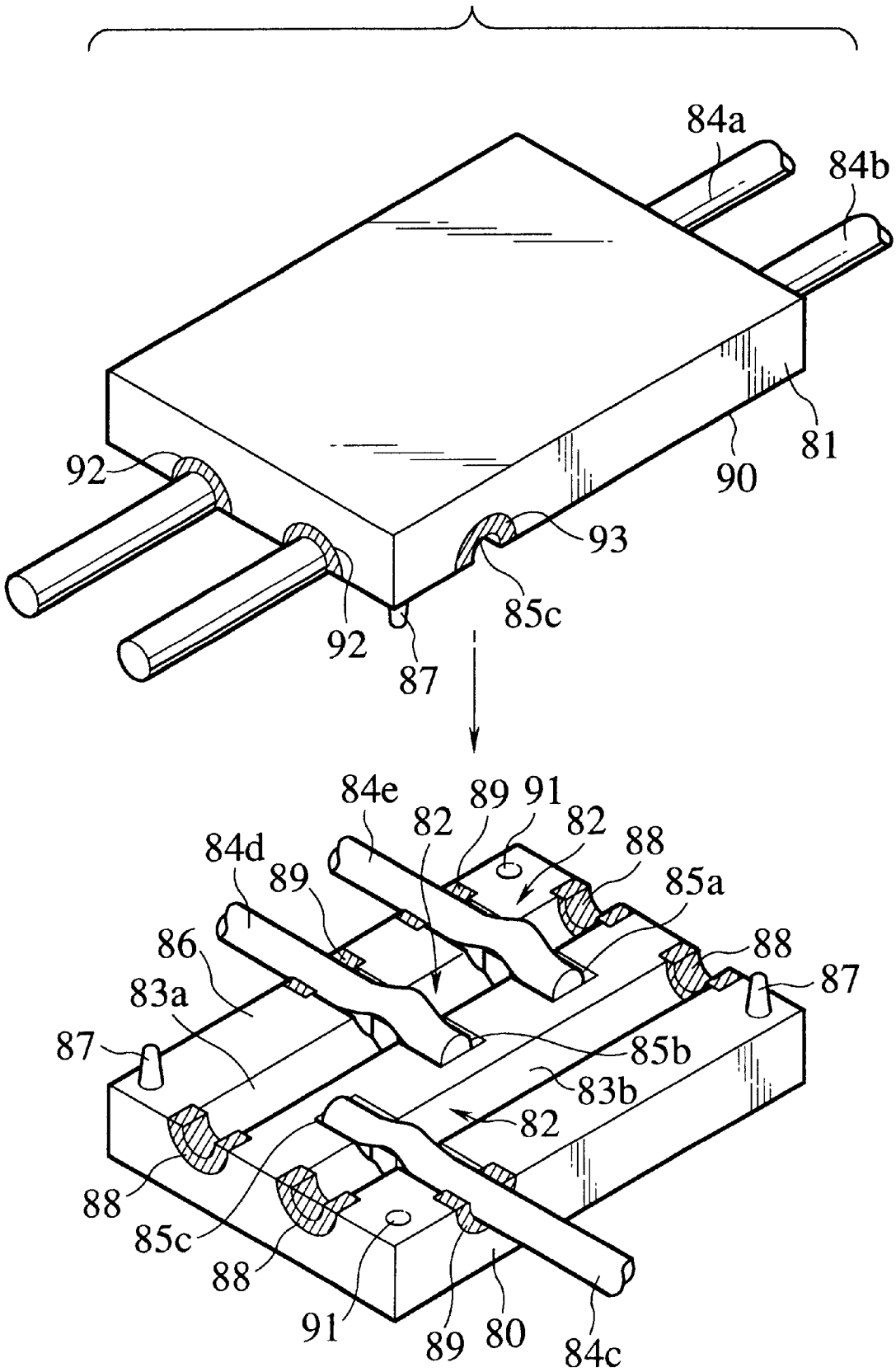
FIG. 9 is a perspective view showing a state in which the covered wires are arranged in the resin housings indicating the matrix joint according to the third embodiment.

A third embodiment of the present invention will be described with reference to FIGS. 8 and 9. This embodiment is an example in which the connection structure for the covered wires according to the present invention is applied to matrix joint. In the matrix joint, a plurality of wires are juxtaposed so as to intersect each other between two resin housings 80 and 81 and then connected at connection portions 82.

One housing 80 made of resin is formed in a plate and contains two wire containing grooves 83*a*, 83*b* which are formed in parallel at a predetermined interval. W1thin the wire containing grooves 83*a*, 83*b* are contained covered wires 84. Further, three connection wire containing grooves 85*a*, 85*b*, 85*c* are provided in parallel to each other at a predetermined interval so as to intersect the wire containing grooves 83*a*, 83*b*. Of the wire containing grooves 85*a*, 85*b*, 85*c*, the wire containing grooves 85*a*, 85*b* intersect the wire containing groove 83*a* and the wire containing groove 85*c* intersects the wire containing groove 83*c*.

On top face of the resin housing 80 are formed main melting portions 86, 86. The main melting portions 86, 86 have positioning projections 87, 87 and positioning holes 91, respectively which are located diagonally. Auxiliary melting portions 88 are formed on both ends of the wire containing grooves 83*a*, 83*b*, and auxiliary melting portions 89 are also formed at outside ends of the connection wire containing grooves 85*a*, 85*b*, 85*c*.

The resin housing 81 for covering the resin housing 80 also includes the wire containing grooves 83*a*, 83*b* and further the connection wire containing grooves 85*a*, 85*b*, 85*c* which are formed in a direction intersecting the wire containing grooves 83*a*, 83*b*. The main melting portions 90, 91 are also formed on the upper resin housing 81 and the positioning projection 87 and positioning hole 91 are provided diagonally thereon. On both ends of the wire containing grooves 83*a*, 83*b* in the upper resin housing 81 are provided the auxiliary melting portions 92 and further the auxiliary melting portions 93 are also provided on the connection wire containing grooves 85*a*, 85*b*, 85*c*.

The main melting portions 86, 90 and auxiliary melting portions 88, 89, 92, 93 of the upper and lower resin housings 80, 81 are formed of the same material as the main melting portions 70, 75 and auxiliary melting portions 71, 76 of the connector housing 60 and cover 63 according to the second embodiment.

When the housings 80, 81 are molded, the main melting portions 86, 90 and portions other than the main melting portions 86, 90 are integrally formed with different materials.

When a plurality of the covered wires 84 (84*a*, 84*b*) and covered wires 84 (84*c*, 84*d*, 84*e*) are matrix-jointed, first the covered wires 84*a*, 84*b* are contained and juxtaposed in the wire containing grooves 83*a*, 83*b* of the upper housing 81. Then, the covered wires 84*c*, 84*d*, 84*e* to be connected are contained in the connection wire containing grooves 83*a*, 83*b*, 83*c* of the lower housing 81. Then, the housings 80, 81 are overlapped with each other.

Then, the housings 80, 81 are pressed and excited by ultrasonic vibration using a ultrasonic horn. Due to this ultrasonic vibration, the cover portions of the wires are melted and removed at the connection portions in which the covered wire 84*a* overlaps the covered wires 84*d*, 84*e* to be connected thereto. By the pressing, the conductive portions of the wires are made into contact with each other. As a result, the covered wire 84*a* is electrically connected to the covered wires 84*d*, 84*e*. At the connection portion 82 in which the covered wire 84*b* overlap the covered wire 84*c* also, the cover portions of the wires are melted and removed by ultrasonic vibration, so that the conductive portions thereof are made into contact with each other.

Further, the main melting portions 86, 90 are melt-fixed to each other by ultrasonic vibration, so that the two housings 80, 81 are integrated. Still further, the auxiliary melting portions 88 and 92, 89 and 93 are melt-bonded and/or melt-fixed each other and melted by ultrasonic vibration so as to be integrated with the melted cover portion of the covered wire 84.

Therefore, the covered wires 84*a*, 84*b* can be matrix-jointed with the covered wires 84*c*, 84*d*, 84*e*.

According to this embodiment, the auxiliary melting portions 88, 89, 92, 93 are formed of material compatible with the cover portion of the covered wire 84. Thus, because the auxiliary melting portions and cover portion of the covered wire 84 are melted by ultrasonic vibration and then integrated, no gap is produced at the introduction portion of the covered wire 84 from the housings 80, 81, so that the connection portions 82 can be securely sealed.

Fourth Embodiment

Next, a fourth embodiment of the present invention will be described with reference to FIG. 10. This embodiment is an example in which the connection structure for the covered wires according to the present invention is applied to connection of the covered wire with the bus bar.

Figure 10:
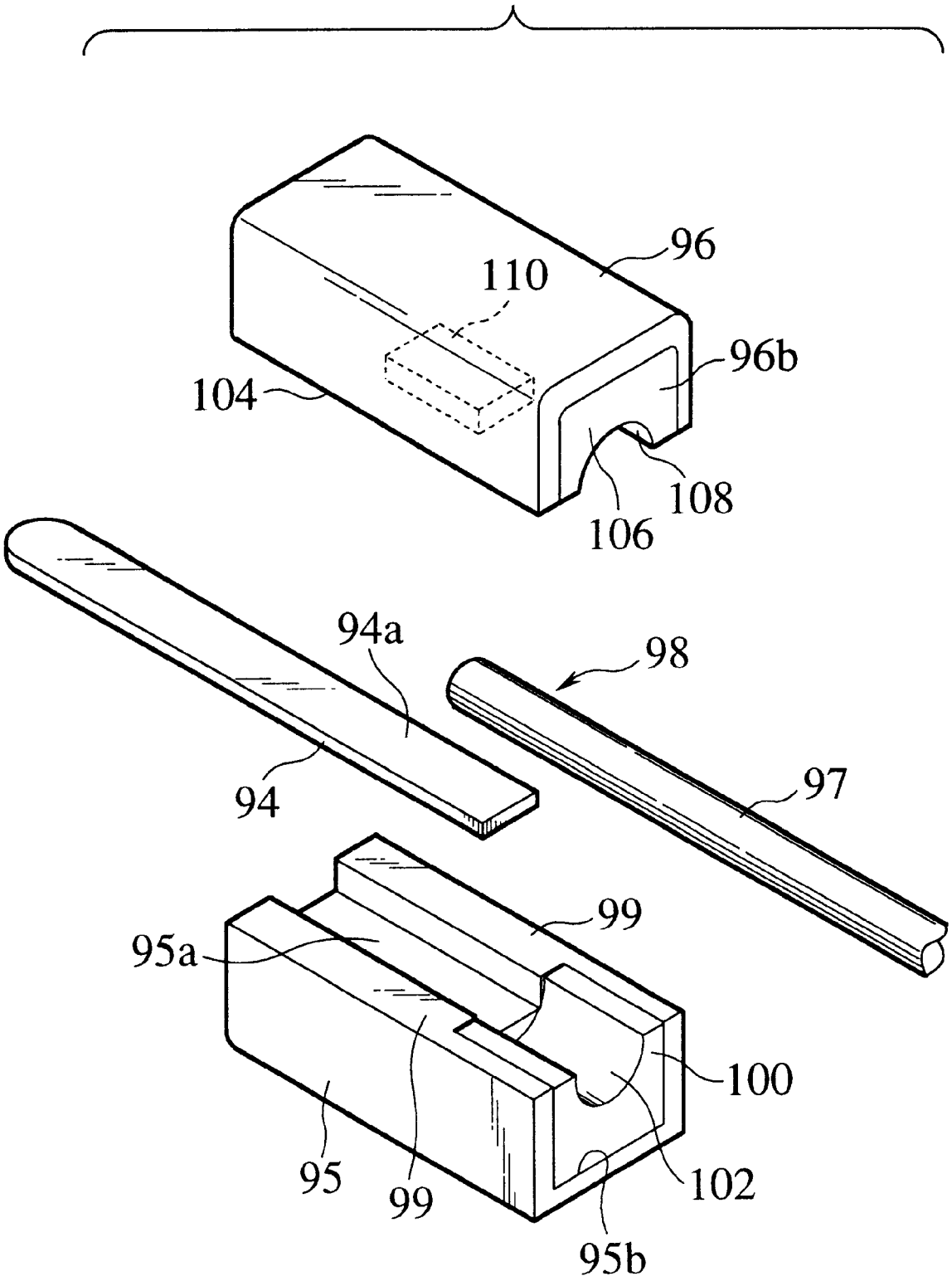
FIG. 10 is a disassembly perspective view showing a connection state of a bus bar and a covered wire, indicating the fourth embodiment of the present invention.

As shown in FIG. 10, the bus bar 94 is contained in a case 95 including a terminal containing groove 95*a* for containing a terminal portion 94*a* and then the terminal containing groove 95*a* is closed by a cover 96. On one end of the case 95 is provided a wire exit 95*b* and correspondingly, the cover 96 also has a wire exit 96*b*. Further, the cover 96 has a connection projection 110 which is inserted into a wire containing groove 95*a* to pinch a connection portion 98 of the bus bar 94 and the covered wire 97 together with a bottom wall of the wire containing groove 95*a*.

Then, on top face on both sides of the wire containing groove 95*a* of the case 95 are formed main melting portions 99 and an auxiliary melting portion 100 is formed at a wire exit 95*b*. In the auxiliary melting portion 100, a wire containing groove 102 having an arc cross section is formed so as to contain an outer periphery of the covered wire 97.

On the other hand, main melting portions 104 are formed on bottom face of the cover 96 and an auxiliary melting portion 106 is formed at a wore exit 96*b*. The auxiliary melting portion 106 also contains a concave portion 108 for containing the covered wire 97.

In this embodiment also, the main melting portions 99, 104 and the auxiliary melting portions 100, 106 of the case 95 and cover 96 are formed of the same material as the main melting portions 70, 75 and the auxiliary melting portions 71, 76 of the connector housing 60 and cover 63 according to the aforementioned second embodiment.

When the case 95 and cover 96 are molded, the main melting portions 99, 104 and portions other than the main melting portions 99, 104 are integrally formed with different materials.

When the terminal portion 94 of the bus bar 94 is connected to the covered wire 97 in the case 95 and cover 96 and the connection portion 98 is sealed, first the terminal portion 94*a* of the bus bar 94 is contained in the terminal containing groove 95*a* of the case 95 and then a cover portion of the covered wire 97 is placed thereon. Next, the top face of the case 95 is covered with the cover 96. Consequently, the connection projection 110 is inserted into the terminal containing groove 95*a*.

Then, the cover 96 and case 95 are pressed and excited by ultrasonic vibration using a ultrasonic horn. As a result, the cover portion of the connection portion 98 is melted and removed so that the terminal portion 94*a* is made into contact with a conductive portion of the covered wire 97 thereby the bus bar being connected to the covered wire 97. Further, because the main melting portions 99, 106 are melt-fixed by ultrasonic vibration, the case 95 and cover 96 are integrally fixed. Further, the auxiliary melting portions 100, 106 and covered wire 97 are melt-bonded and/or melt-fixed each other and melted by ultrasonic vibration and then integrated.

According to this embodiment as well, the auxiliary melting portions 100, 106 are compatibilized with the cover portion of the covered wire 97 by ultrasonic vibration. Therefore, no gap is produced at the wire exits 95*b*, 96*b*, so that the connection portion 98 can be securely sealed.

What is claimed is:

1. A covered wire connection structure for conductively connecting members at least one of which is a covered wire having a conductive wire portion and a cover portion formed by coating resin around an outer periphery of the conductive wire portion, said covered wire connection structure formed by the steps of: overlapping said members with each other at a connection portion; pinching the connection portion between resin materials; melting and removing said cover portion by an ultrasonic vibration; pressing said resin materials from an outside thereof so as to conductively connect said members at the connection portion; and melting said resin materials by the ultrasonic vibration so as to be fixed to each other thereby sealing said connection portion, each of said resin materials comprising:

one or more melting portions and one or more auxiliary portions wherein, said one or more main melting portions disposed on the resin materials respectively are melt-fixed to each other as said connection portion is pinched between said resin materials and said one or more auxiliary portions disposed on the resin materials respectively are formed of material which is compatibilized with said cover portion of the covered wire by the ultrasonic vibration so as to be compatibilized with said cover portion introduced from said connection portion and to be melt-bonded to each other.

2. A covered wire connection structure according to claim 1 wherein, said main melting portions are melt-fixed to each other with said connection portion pinched therebetween so as to seal said connection portion and said auxiliary melting portions are compatibilized with said cover portion introduced from said melting portions.

3. A covered wire connection structure according to claim 1 wherein, said auxiliary melting portions are melt-fixed to each other.

4. A covered wire connection structure formed by the steps of: overlapping covered wires each having a conductive wire portion and a cover portion formed by coating resin around an outer periphery of the conductive wire portion with each other at a connection portion; pinching the connection portion with a pair of resin chips; melting and removing said cover portion by an ultrasonic vibration; pressing said resin chips from an outside thereof so as to conductively connect said covered wires at the connection portions; and melting said resin chips by the ultrasonic vibration so as to be fixed to each other thereby sealing said connection portion, each of the pair of said resin chips comprising:

one or more melting portions and one or more auxiliary portions wherein, said one or more main melting portions disposed on the resin chips respectively are melt-fixed to each other as said connection portion is pinched between said resin chips and said one or more auxiliary melting portion disposed on the resin chips respectively are formed of material which is compatibilized with the cover portions of the covered wires by the ultrasonic vibration so as to be compatibilized with said cover portions introduced from said connection portion and to be melt-bonded to each other.

5. A covered wire connection structure according to claim 4 wherein, said melting portions are melt-fixed to each other with said connection portion pinched therebetween so as to seal said connection portion and said auxiliary melting portions are compatibilized with said cover portion introduced from said melting portions.

6. A covered wire connection structure according to claim 4 wherein, said auxiliary-melting portion of one of said resin chips is formed in convex shape having a wire containing groove for containing said covered wire, said auxiliary melting portion of the other resin chip is formed in concave shape having a wire containing groove for containing said covered wire so as to engage said one auxiliary melting portion and said covered wire introduced from said connection portion is pinched by said one auxiliary melting portion and said other auxiliary melting portion.

7. A covered wire connection structure according to claim 1 wherein, said main melting portions and portion other than said main melting portions including at least said auxiliary melting portions are integrally formed in two-color-part molding manner.

8. A covered wire connection structure formed by the steps of: overlapping a covered wire with a terminal portion at a connection portion, said covered wire having a conductive wire portion and a cover portion formed by coating resin around an outer periphery of the conductive wire portion, said terminal portion disposed in a terminal containing portion of a housing made of resin; pinching the connection portion with said terminal containing portion and a resin cover for covering said terminal containing portion; melting and removing said cover portion by ultrasonic vibration; pressing said resin cover from the outside thereof so as to conductively connect said covered wire to said terminal portion, at the connection portion and melting said terminal containing portion and said resin cover so as to be fixed to each other thereby sealing said connection portions, each of said terminal containing portion and said resin cover comprising:

one or more melting portions and one or more auxiliary portion wherein, said one or more main melting portions disposed on said terminal containing portion and said resin cover respectively are melt-fixed to each other as said connection portion is pinched between said terminal containing portion and said resin cover and said one or more auxiliary melting portions disposed on said terminal containing portion and said resin cover respectively are formed of material which is compatibilized with the cover portion of the covered wire by the ultrasonic vibration so as to be compatibilized with said cover portion introduced from said connection portion and to be melt-bonded to each other.

9. A covered wire connection structure according to claim 8 wherein, said terminal containing portion has a terminal containing groove for containing said connection portion and said resin cover has a connection projection inserted into said terminal containing groove so that said connection portion is pinched between said connection projection and a bottom wall in said terminal containing groove.

10. A covered wire connection structure formed by the steps of: overlapping plural juxtaposed first covered wires with plural juxtaposed second covered wires in a direction intersecting said first covered wires at respective connection portions, each of the first and second plural juxtaposed covered wires having a conductive wire portion and a cover portion formed by coating resin around an outer periphery of the conductive wire portion; pinching each of the connection portions with a pair of resin housings; melting and removing said cover portions by an ultrasonic vibration; pressing said resin housings from an outside thereof so as to conductively connect said first covered wires to said second covered wires at said respective connection portions, and melting said pair of the resin housings by the ultrasonic vibration so as to be fixed to each other thereby sealing said respective connection portions, each of said resin housings comprising:

one or more meltng portions and one or more auxiliary portions wherein, said one or more main melting portions disposed on said resin housings respectively are melt-fixed to each other as said connection portions are pinched between said resin housings and said one or more auxiliary melting portions disposed on said resin housings respectively are formed of material which is compatibilized with the cover portions of the covered wires by the ultrasonic vibration so as to be compatibilized with said cover portions introduced from said connection portions and to be melt-bonded to each other.

11. A covered wire connection structure according to claim 1, 4, 8 or 10 wherein, said cover portions are formed of vinylidene chloride and said auxiliary melting portions are formed of polyester elastomer compatible with said vinylidene chloride.

* * * * *